US005131189A

United States Patent [19]

Mascotte

[11] Patent Number: 5,131,189

[45] Date of Patent: Jul. 21, 1992

[54] SECURITY DOOR HAVING ANTIPRYING MEMBER

[76] Inventor: Lawrence L. Mascotte, 9106 SE. 82nd, Portland, Oreg. 97266

[21] Appl. No.: 697,446

[22] Filed: May 9, 1991

Related U.S. Application Data

[63] Continuation-in-part of Ser. No. 627,337, Dec. 14, 1990, abandoned.

[51] Int. Cl.[5] ..... E05B 17/00

[52] U.S. Cl. ..... 49/460; 70/417; 70/418; 292/346

[58] Field of Search ..... 49/460; 70/416, 417, 70/418; 292/346

[56] References Cited

U.S. PATENT DOCUMENTS

| | | | |
|---|---|---|---|
| 3,761,119 | 9/1973 | Bennett | 292/346 |
| 3,976,318 | 8/1976 | Krus | 70/416 X |
| 3,996,774 | 12/1976 | Best | 70/416 X |
| 4,130,311 | 12/1978 | Sushan | 292/346 |
| 4,458,931 | 7/1984 | McBurnie | 49/460 X |
| 4,484,463 | 11/1984 | Hennessy | 70/417 X |
| 4,663,950 | 5/1987 | Mascotte | 70/416 X |

*Primary Examiner*—Philip C. Kannan
*Attorney, Agent, or Firm*—Adrian J. LaRue

[57] ABSTRACT

An antiprying member is secured onto a metal frame adjacent a protective flap member secured onto a security door that is hingedly mounted onto the metal frame. The antiprying member extends along the free end of the flap member and has a thickness at least the same as that of the flap member and is spaced from the flap member no greater than the thickness of the flap member to prevent a prying member from bending the flap member away from the metal frame or to pry open the security door. A pin having an annular notch is secured to the flap member and extends through a hole in the door frame to prevent the door frame from being pried or twisted away from the door.

9 Claims, 2 Drawing Sheets

FIG. 5
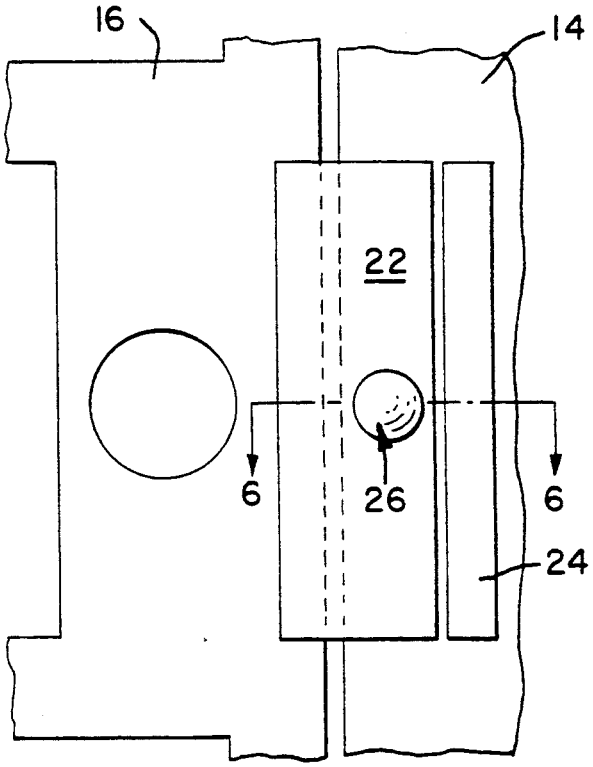
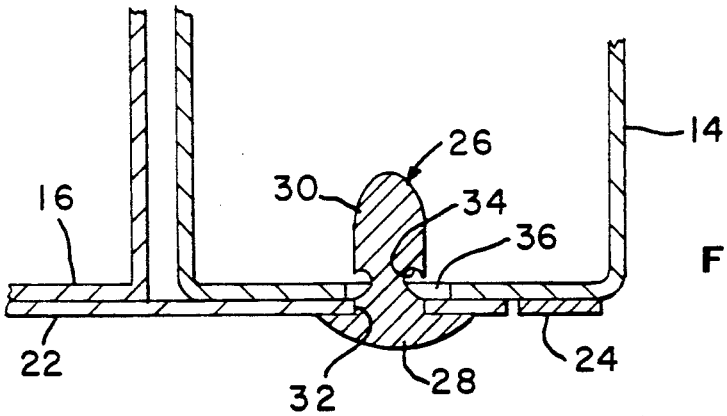
FIG. 6
FIG. 7
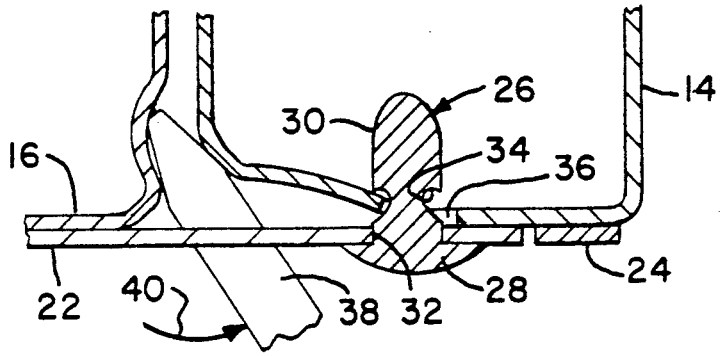

SECURITY DOOR HAVING ANTIPRYING MEMBER

CROSS REFERENCE TO RELATED APPLICATION

This application is a continuation-in-part application of U.S. patent application Ser. No. 07/627,337 filed Dec. 14, 1990 now abandoned.

FIELD OF THE INVENTION

This invention relates to flap members that cover door latches and locks of security doors and more particularly to means to prevent prying open a security door via the flap member including means to prevent the door frame from being pried or twisted away from the door.

BACKGROUND OF THE INVENTION

A metal security door is disclosed in U.S. Pat. No. 4,663,950 and it is hingedly mounted onto a metal frame that is secured around a doorway of a building. A metal flap member is secured onto the metal frame of the security door along the section of the door frame containing the door latch and lock. The flap member extends across -the doorway metal frame when the security door is in a closed and locked position. The flap member protects the door latch and lock thereby preventing access to them via a hacksaw or chisel to break open the security door.

While the protective flap member protects against the use of hacksaws, chisels or the like, it has been found that it serves as a means for engagement by a crowbar or other prying member for prying open the security door wherein the crowbar or prying member engages the flap member and the door frame and upon pressure being applied to the crowbar, the flap member serves to pry the door open or the flap member can be bent away from its normal position to enable access to the door lock.

It is therefore a primary object of the present invention to provide mean to prevent use of the protective flap member on a security door as a prying member for prying open the security door or to enable the flap member to be bent away from its normal position. The flap member is also provided with means that engages the door frame when a prying member is inserted between the door frame and the door thereby preventing twisting of the door frame and the frame of the door so as to obtain access to the lock or to move the lock free of the door frame.

SUMMARY OF THE INVENTION

According to the present invention, an antiprying member is secured onto the door frame along a section of the frame containing the matable door latch and locking member and opposed to the flap member secured onto the door that covers the door latch and locking member when the door is closed, the space between the antiprying member and the flap member being no greater than the thickness of the flap member, the antiprying member having a length at least equal to that of the flap member and the thickness of the antiprying member being at least as thick as the flap member.

The flap member includes a pin that is disposed in a hole of the door frame, the pin having a notch that will engage a surface of the hole when a prying member inserted between the door frame and the door is used to bend or twist the door frame or frame of the door to obtain access to the lock or move the lock free of the door frame.

BRIEF DESCRIPTION OF THE DRAWING

The invention, together with objects and advantages thereof, is best understood by way of example with reference to the following detailed description in conjunction with the accompanying drawings.

FIG. 5 is a view similar to FIG. 3 showing an alternative embodiment of the invention.

FIG. 6 is a cross-sectional view taken along line 6—6 of FIG. 5.

FIG. 7 is a view similar to FIG. 6 showing the operation of the pin when a prying member is used.

DETAILED DESCRIPTION OF THE INVENTION

Figure 1:
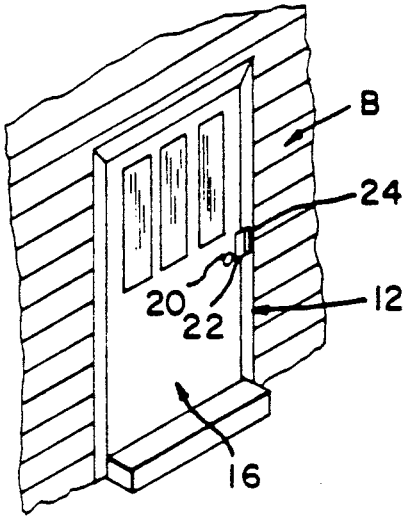
FIG. 1 is a part perspective view of a building including a door.
Figure 2:
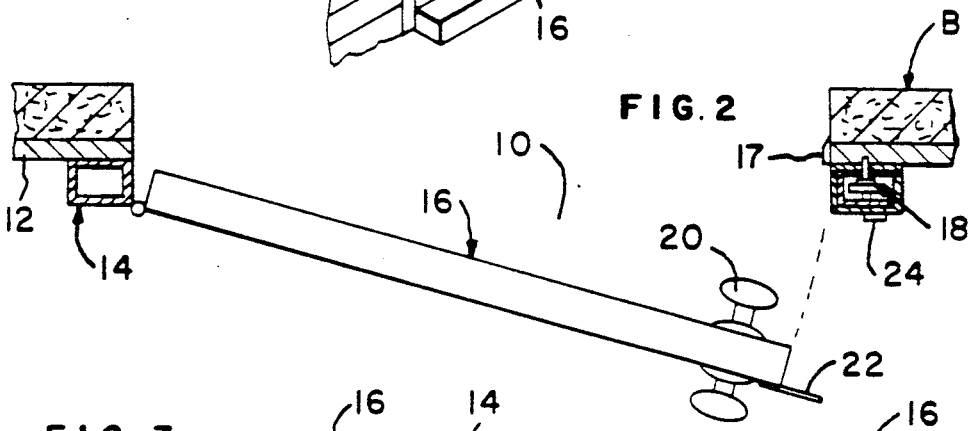
FIG. 2 is a cross-sectional view of FIG. 1 showing the door in a part open position.

As shown in FIGS. 1 and 2, a building B has a doorway 10 around the outside of which is an existing door frame 12. A hollow metal frame 14 is secured onto existing frame 12. A security door 16 is hingedly mounted onto metal frame 14 and is locked in a closed position by lock 18 mounted in an opening in frame 14. Door 16 has a metal frame and acts as a security door to prevent unauthorized access to the building when it is at a closed and locked position. Door 16 also has a handle 20 and an associated conventional door latch (not shown) and locking member as disclosed in U.S. Pat. No. 4,663,950, the disclosure of which is incorporated herein, to lock door 16 in its closed position via lock 18 against stop member 17 on frame 12.

Figure 3:
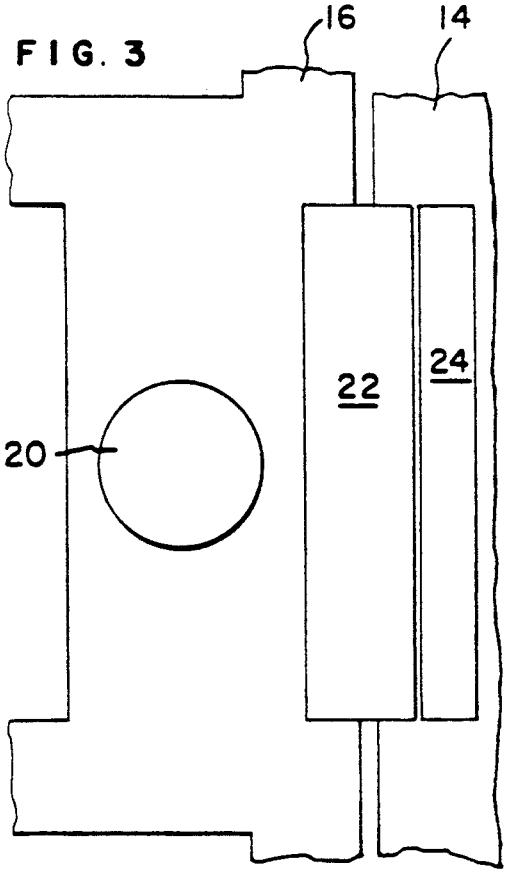
FIG. 3 is a part front elevational view of FIG. 1 showing the door in a closed position and the flap member and antiprying member adjacent thereto.

A metal protective flap member 22 is secured on the metal frame of door 16 preferably by welding and extends along the latch and lock members of the door as well as extending outwardly from the door for engagement with frame 14 as shown in FIG. 3 when the door is in a closed position. Flap member 22 is sufficiently thick so as not to be easily bent and it covers the latch and lock members to protect them from access by a hacksaw, chisel or the like.

In order to prevent flap member 22 from being engaged by a prying member, such as a crowbar or the like, between frame 14 and flap member 22 to pry the flap member to a position so that a hacksaw or chisel can be used on the latch and lock members or to pry the door open, an antiprying metal member 24 is secured preferably by welding onto frame 14 along flap member 22, as shown in FIG. 3.

The thickness of antiprying member 24 must be at least as thick as that of flap member 22; however, it can be thicker. Also, the space between flap member 22 and antiprying member 24 must be no wider than the thickness of flap member 22.

With antiprying member 24 secured on frame 14 adjacent flap member 22, having the thickness as indicated and being spaced no further from flap member 22 than the thickness of the flap member, such arrangement will prevent flap member 22 from being pried away from frame 14 or prying open the closed and locked door because antiprying member 24 will prevent use of a prying member on flap member 22.

Figure 4:
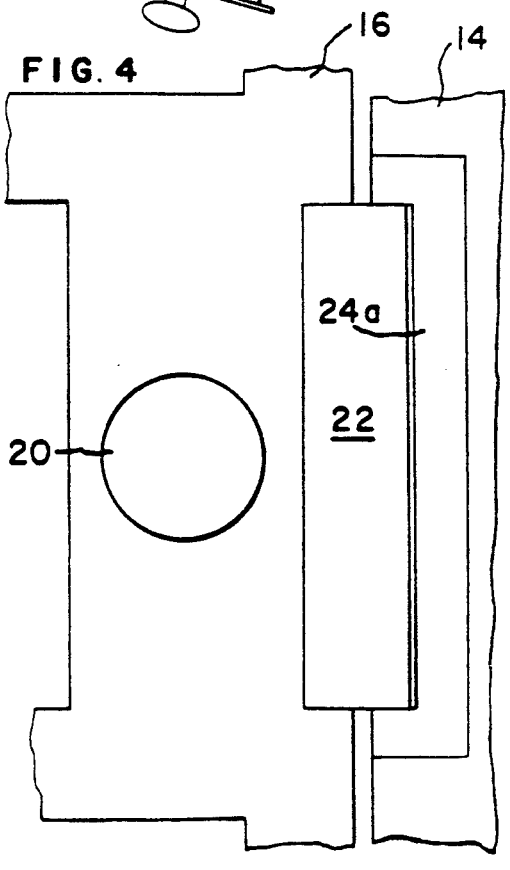
FIG. 4 is a view similar to FIG. 3 showing an alternative embodiment of the antiprying member.

The antiprying member 24 of FIG. 3 can best be used on security doors with rather heavy gauge metal flap members that are not easily bent even though a prying member could be applied to the top and bottom of the flap member. In order to prevent access to the top and bottom of flap member 22, antiprying member 24*a*, as shown in FIG. 4, can be weldingly secured onto frame 14. As can be seen, antiprying member 24*a* is a U-shaped member such that the legs of member 24*a* extend along the sections of the top and bottom of flap member 22 that extend along frame 14 and the bight of member 24*a* extends along the free end of flap member 22. Member 24*a* must be as thick as or thicker than flap member 22 and the space between flap member 22 and the legs and bight of U-shaped antiprying member 24*a* must be no wider than the thickness of flap member 22. The U-shaped antiprying member 24*a* will prevent access to the ends or free end of flap member 22 by a prying member. This arrangement will permit the use of less heavy gauge metal than that used in conjunction with antiprying member 24.

An antiprying member positioned adjacent a protective flap member to prevent prying the flap member away from its normal position in engagement with the frame member or to pry open the security door has been disclosed.

FIGS. 5–7 show an alternative embodiment of the present invention. A pin 26 of hardened metal is secured onto flap member 22. Pin 26 has a head 28 engaging an outer surface of flap member 22 and a shank 30 extends through an aperture 32 in flap member 22. Shank 30 has an annular notch 34 at its inner end adjacent the inner surface of flap member 22.

When door 16 is in a closed position, as shown in FIGS. 5 and 6, shank 30 extends through hole 36 in door frame 14 and flap member 22 engages door frame 14 with the door latch and the door lock maintaining door 16 in a latched and locked condition. Antiprying member 24 or 24*a* is secured on door frame 14 to prevent flap member 22 from being pried away from frame 14 or prying open the closed and locked door as heretofore described.

If a prying member 38, as shown in FIG. 7, is placed between door 16 and frame 14 and operated as shown by arrow 40 to pry the door 16 away from the door frame 14, the metal door frame and that of the door will be bent causing the surface of hole 36 to be moved into annular notch 34 to prevent the door frame from moving any further to the right thereby preventing the lock from being moved free of the door frame. Moreover, the outer edge of the annular notch 34 has a sharp edge that will bite into the door frame which will limit the amount of bending or twisting of the door frame or door so that larger prying members cannot be used as only a small prying member can only be used initially to commence the prying operation.

If the prying member 38 is moved in the opposite direction, the surface of hole 36 will be moved in annular notch 34 and the same thing will happen as explained above.

A pin having an annular notch as part of a protective flap member on a security door extends through a hole in a door frame to prevent the door frame from being pried or twisted away from the door has been disclosed.

I claim:

1. A security door for a building, comprising:

a metal frame for mounting onto the building and extending along the sides and upper end of a doorway;

a security door hingedly mounted onto the metal frame and movable between closed and open positions;

a protective flap member secured onto the security door overlying the latch and lock members thereof and engaging a section of the metal frame when the door is in a closed position to protect the latch and lock members; and an antiprying member secured onto the section of said metal frame and extending along the free end of said flap member, said antiprying member having a thickness at least the same as that of said flap member and being spaced from the flap member no greater than the thickness of said flap member.

2. A security door according to claim 1, wherein said antiprying member is U-shaped so that legs of the antiprying member extend along the top and bottom ends of the flap member and the bight of the antiprying member extends along the free end of the flap member.

3. A security door for a building, comprising:

a metal frame for mounting onto the building and extending along the sides and upper end of a doorway;

a security door hingedly mounted onto the metal frame and movable between closed and open positions;

a protective flap member secured onto the security door overlying the latch and lock members thereof and engaging a section of the metal frame when the door is in a closed position to protect the latch and lock members; and a pin member having notch means secured onto said protective flap member and disposed in a hole in said metal frame when the flap member engages the metal frame so that upon a prying member being disposed between the metal frame and the door and prying forces being applied thereto, the surface of the hole is forced into the notch means thereby preventing the metal frame being pried or twisted away from the door.

4. A security door according to claim 3, wherein said notch means is annular.

5. A security door according to claim 3, wherein an outer edge of said notch means has a sharp edge.

6. A security door according to claim 3, wherein an antiprying member is secured onto the section of the metal frame and extending along the free end of said flap member, said antiprying member having a thickness at least the same as that of said flap member and being spaced from the flap member no greater than the thickness of said flap member.

7. For use in a doorway closure of the type that includes a frame, a door hinged to the frame to swing outwardly for opening thereof, and latch and lock mechanisms on the frame and door for securing the door in a closed position in the frame, the latch and lock mechanisms having plungers for position in openings in the door frame, a protective flap member secured onto the door overlying the latch and lock mechanisms and engaging a section of the frame when the door is in the closed position to protect the latch and lock mechanisms; an antiprying member secured onto the section of the frame adjacent an edge of the protective flap member, said antiprying member extending along at least the entire length of the protective flap member and having a thickness at last the same as that of the protective flap member and being spaced from the edge of the protective flap member no greater than the thickness of the protective flap member.

8. An antiprying member as claimed in claim 7, wherein said antiprying member is U-shaped so that the legs of the antiprying member extend along the upper and lower edges of the protective flap member and the bight of the antiprying member extends along the outer edge of the protective flap member.

9. An antiprying member as claimed in claim 7, wherein a pin member having notch means is secured onto the protective flap member and is disposed in a hole in the frame when the protective flap member engages the frame so that upon a prying member being disposed between the frame and the door and prying forces being applied thereto, the surface of the hole is forced into the notch means thereby preventing the frame being pried or twisted away from the door.

* * * * *